US012709781B2

(12) United States Patent
Raja et al.

(10) Patent No.: US 12,709,781 B2
(45) Date of Patent: Aug. 18, 2026

(54) METHOD OF HEAT TREATING A STEEL COMPONENT

(71) Applicant: AKTIEBOLAGET SKF, Gothenburg (SE)

(72) Inventors: Shanjith Raja, Gothenburg (SE); Rolando Velazquez, Gothenburg (SE); Karl Åke Staffan Larsson, Gothenburg (SE)

(73) Assignee: AKTIEBOLAGET SKF, Gothenburg (SE)

( * ) Notice: Subject to any disclaimer, the term of this patent is extended or adjusted under 35 U.S.C. 154(b) by 455 days.

(21) Appl. No.: 18/459,514

(22) Filed: Sep. 1, 2023

(65) Prior Publication Data

US 2024/0084413 A1 Mar. 14, 2024

(30) Foreign Application Priority Data

Sep. 13, 2022 (DE) ..... 102022209535.9

(51) Int. Cl.
*C23C 8/26* (2006.01)
*C21D 8/0247* (2026.01)

(52) U.S. Cl.
CPC ..... *C21D 8/0257* (2013.01)

(58) Field of Classification Search
CPC ..... C23C 8/26; C21D 1/78
See application file for complete search history.

(56) References Cited

U.S. PATENT DOCUMENTS

2007/0151634 A1* 7/2007 Fujita ..... C22C 38/02 148/318

* cited by examiner

*Primary Examiner* — Jessee R Roe
(74) *Attorney, Agent, or Firm* — J-TEK LAW PLLC; Scott T. Wakeman; Mark A. Ussai

(57) ABSTRACT

A method of heat treating a steel component includes (i) providing the steel component, (ii) nitriding the steel component at a temperature of 800 to 920° C. and a pressure of 20 to 50 mbar for 30 minutes to 8 hours to form a nitrided steel component, and (iii) after step (ii) heating the nitrided steel component at a temperature of 800 to X° C. and a pressure of 1400 to 3000 mbar for at least 30 minutes, where X° C. is about 80° C. less than a melting temperature of the steel and is preferably about 1250° C. to 1350° C.

17 Claims, 4 Drawing Sheets

METHOD OF HEAT TREATING A STEEL COMPONENT

CROSS-REFERENCE

This application claims priority to German patent application no. 10 2022 209 535.9 filed on Sep. 13, 2022, the contents of which are fully incorporated herein by reference.

TECHNOLOGICAL FIELD

The present disclosure is directed to a method of heat treating a steel component and a steel component that has been subjected to such a method. Examples of suitable steel components include components for bearings or the like, such as a rolling element, roller or ball, and/or an inner or outer ring, for example.

BACKGROUND

Carbonitriding is a metallurgical surface modification technique that is used to increase the surface hardness of a metal component, thereby reducing the wear of the component during use. During the carbonitriding process, atoms of carbon and nitrogen diffuse interstitially into the metal, creating barriers to slip and increasing the hardness near the surface, typically in a layer that is 0.1 to 0.3 mm thick, but a thickness of 1 to 2 mm can also be achieved. Carbonitriding is usually carried out a temperature of about 850 to about 860° C.

Carbonitriding is normally used to improve the wear resistance of steel components comprising low or medium carbon steel, and rarely high carbon steel. Although steel components comprising high carbon steel are stronger, they have been found to be more susceptible to cracking in certain applications. Components may, for example, be used in typically dirty environments, such as in a gear box, where lubricating oil is easily contaminated, and it is well known that the service life of components can decrease considerably under such conditions. Particles in the lubricant can get in between the various moving parts of a gear box, for example, and make indentations in their contact surfaces. Stress is concentrated around the edges of these indentations, and the contact stress concentrations may eventually lead to fatigue cracking. Using components damaged in this way may also result in an increase in the noise generated by the components.

For high (and some medium) carbon steels, carbonitriding may not be necessary, since the carbon content of the steel is already high. Such steel grades may therefore only be nitrided, for example. Nitriding only involves diffusing nitrogen atoms interstitially into the metal, i.e. and not diffusing carbon atoms interstitially into the metal.

Low pressure nitriding (LPN) is a nitriding treatment method that involves preforming a nitriding process at reduced pressure, such as in a vacuum furnace. Such LPN treatments in general aim to increase the nitrogen content at the surface of the steel component, such as a component of a bearing, in order to improve its mechanical properties. Using ammonia, for example, the surface nitrogen content of the steel component can be increased. However, a reproducible method of performing LPN in which nitrogen is reliably and consistently diffused into the steel has not yet been formulated, even by furnace manufacturers, for example.

Similar low pressure carbonitriding (LPCN) processes are also known. LPCN processes may generally be used for lower carbon steels.

During testing, with high carbon steels in particular, it has been observed that after typical LPN or LPCN methods, the carbon content of a steel may also be reduced near the surface of the steel, such as to about 0.3 to about 0.4 wt. %. This is undesirable. To avoid this, conventional methods may involve "boosting" the carbon content to maintain the desirable higher carbon content close to the surface. Such carbon "boosting" may involve introducing acetylene towards the end of the LPN or LPCN process in order to increase the surface carbon content of the steel component and thereby counteract the loss in carbon content near the surface. Without wishing to be bound by theory, it is thought that the reduced carbon content near the surface may be caused by uphill diffusion of the carbon away from the surface during the LPN or LPCN method.

Such conventional LPN or LPCN methods may also result in a high nitrogen content at the surface, which rapidly decreases away from the surface.

Accordingly, there remains a need to provide an improved steel heat treatment process involving LPN or LPCN that results in a more desirable surface profile of carbon and nitrogen content.

SUMMARY

The present disclosure seeks to tackle at least some of the problems associated with the prior art or at least to provide a commercially acceptable alternative solution thereto.

Accordingly, the present disclosure provides a method of heat treating a steel component and a heat-treated steel component.

Specifically, in a first aspect a method of heat treating a steel component is disclosed which comprises: (i) providing a steel component; (ii) nitriding the steel component at a temperature of 800 to 920° C. and a pressure of 20 to 50 mbar for 30 minutes to 8 hours to form a nitrided steel component; and (iii) subjecting the nitrided steel component to a further treatment comprising heating at a temperature of 800 to X° C. and a pressure of 1400 to 3000 mbar for at least 30 minutes, where X° C. is about 80° C. less than the melting temperature of the steel.

Each aspect or embodiment as defined herein may be combined with any other aspect(s) or embodiment(s) unless clearly indicated to the contrary. In particular, any features indicated as being preferred or advantageous may be combined with any other feature indicated as being preferred or advantageous.

Surprisingly, it has been found that performing the step (iii) after an LPN step (ii) may result in a steel component that contains a more desirable carbon and nitrogen surface profile as compared to a steel component that has only undergone an LPN treatment, for example. Until now, this has not generally been possible for steel components that have undergone an LPN treatment. That is, it has not generally been possible to obtain a more uniform carbon and/or nitrogen profile near the surface of an LPN-treated steel component.

In other words, it has surprisingly been found that the drop in carbon content at the surface of the steel component after LPN treatment can be reversed, and the diffusion of nitrogen further into the steel component away from the surface can be achieved, for example, by further applying step (iii) of the invention after applying step (ii). Further step (iii) can unexpectedly achieve these advantages simultaneously, i.e. by the same single process step.

Without wishing to be bound by theory, it is thought that the conditions of step (iii), such as the pressure, may enable the uphill diffusion of the carbon away from the surface that occurred during step (ii) to be reversed, while simultaneously allowing the nitrogen to diffuse further into the surface of the steel component.

Accordingly, a heat-treated steel component having advantageous surface carbon and nitrogen profiles can be obtained, while maintaining the benefits of LPN compared to conventional nitriding processes. In other words, a large case depth can be achieved, even after LPN treatment. That is, a steel component having high surface hardness and improved wear resistance, for example, can be obtained.

LPN and LPCN processes are typically used for gears, for example, which may conventionally have a smaller case depth. However, with the method of the present invention, it may now be possible to apply LPN and/or LPCN processes to bearings or the like, which generally have larger case depths, such as from 2.5 to 2.7 mm.

It should be noted that such a carbon and nitrogen surface profile may be achieved by some conventional (i.e. not low pressure) nitriding or carbonitriding treatment processes. However, LPN processes offer many advantages over the conventional nitriding processes, such as less oxidation of the steel and better nitriding homogeneity, for example. Steel components that have undergone LPN can also be distinguished from steel components that have undergone conventional nitriding processes by other properties and techniques, such as the change in composition caused by manganese effusion, for example, which may occur during LPN, but not generally in conventional nitriding processes, and the amount of oxidation that takes place at grain boundaries.

The term "heat treating" as used herein may encompass steps of applying heat and/or pressure changes to the steel component in order to impart certain mechanical, physical or chemical properties on the steel component, for example. Heat treatment of steel components, in general, is well-known to the skilled person. The method of the disclosure is a method of heat treating a steel component. However, of course, the invention could also be described as a method of nitriding (or carbonitriding) a steel component, for example, as appropriate.

The term "steel component" as used herein may encompass any component, i.e. any object, made of or comprising steel. The invention is not limited to a particular type or grade of steel. The type of "component" as used herein is not particularly limited. However, preferably, the component comprises a component for a bearing or the like, such as a rolling element, roller or ball, and/or an inner or outer bearing ring, for example.

The method of the invention comprises the sequential steps (i)-(iii). The term "sequential steps" as used herein means that the steps listed thereafter are performed in the order in which they are listed. In other words, in the present invention the steps (i)-(iii) are performed in the order (i), (ii), then (iii). The term "sequential steps" as used herein encompasses the option of including further steps before, after, or in between any of the listed steps. However, the term "sequential steps" as used herein also encompasses the option that each step directly follows the previously-listed step, i.e. with no intervening steps. For example, preferably, step (ii) directly follows step (i), i.e. there is preferably no intervening step between step (i) and step (ii), and step (iii) preferably directly follows step (ii), i.e. there is preferably no intervening step between step (ii) and step (iii). In one preferred embodiment, for example, the method comprises no further steps between any one of the listed steps (i)-(iii). In some preferred embodiments, the method of the present invention consists of the method steps (i), (ii) and (iii), optionally followed by non-heat-treatment steps, such as any machining processes.

After step (i) of providing a steel component, the method comprises (ii) nitriding the steel component. The term "nitriding" as used herein takes on its usual meaning in the art, which is well known to the skilled person. In other words, the term "nitriding" is a term of art, as described above in the background section, for example. In the present invention, step (ii) of nitriding the steel component comprises nitriding the steel component at a temperature of 800 to 920° C. and a pressure of 20 to 50 mbar for 30 minutes to 8 hours. Preferably, step (ii) of nitriding the steel component comprises nitriding the steel component in an atmosphere comprising ammonia at a temperature of 800 to 920° C. and a pressure of 20 to 50 mbar for 30 minutes to 8 hours. In other words, step (ii) of the present invention is therefore a form of LPN. For the avoidance of doubt, step (ii) involves simultaneously applying a temperature of 800 to 920° C. and a pressure of 20 to 50 mbar, for 30 minutes to 8 hours. Step (ii) of the invention therefore forms a nitrided steel component. In other words, step (ii) of the invention may form a nitrided layer on at least a portion of the surface of the steel component. The term "nitrided" as used herein may encompass that the object has undergone a nitriding treatment, such as to form a nitrided layer on at least a portion of the surface of the object. Such a term is well known to the skilled person.

The temperature and/or pressure during the nitriding step is not necessarily kept constant within the range of 800 to 920° C. and from 20 to 50 mbar, respectively. That is, the temperature and/or pressure may be varied during step (ii).

If the temperature is less than 800° C., for example, then the uptake of nitrogen into the steel may be slower, and therefore the depth of the nitrogen atoms into the steel surface may be smaller, which is undesirable. If the temperature is higher than 920° C., for example, then the ammonia may combust, which is not only unsafe, but also wastes reactant resources. In particular, without wishing to be bound by theory, it is thought that at the temperatures and pressures used in this step, the ammonia dissociates into nitrogen and hydrogen atoms. Then, at higher temperatures the dissociated nitrogen atoms may combine together to form nitrogen molecules (N 2) at a faster rate. In this way the concentrations of nitrogen atoms in the atmosphere may be reduced at a higher rate and therefore not diffuse into the steel. Moreover, when the pressure is higher than 50 mbar and the temperature is higher than 920° C., the ammonia may be more likely to combust and there may also be more possibility for leakage.

Preferably, step (ii) of nitriding the steel component comprises nitriding the steel component in an atmosphere comprising ammonia. Preferably, the atmosphere consists of ammonia, together with any unavoidable impurities. In other words, the atmosphere preferably comprises about 100 vol. % ammonia. Unavoidable impurities may be present, for example, in an amount of less than 0.1 vol. % based on the total volume of gas in the system, such as in the chamber or furnace. The ammonia may be introduced at any time during the nitriding step while the temperature is maintained at from 800 to 920° C., for example.

In some embodiments, step (ii) of nitriding the steel component may preferably encompass carbonitriding the steel component. Such embodiments may be required for lower-carbon steels. In such embodiments, step (ii) may therefore comprise carbonitriding the steel component at a temperature of 800 to 920° C. and a pressure of 20 to 50 mbar for 30 minutes to 8 hours. In this embodiment, step (ii) of the invention therefore forms a carbonitrided steel component. The term "carbonitriding" as used herein takes on its usual meaning in the art, which is well known to the skilled person. In other words, the term "carbonitriding" is a term of art. In other words, in this embodiment, step (ii) is a form of LPCN. Compared to LPN, the LPCN step may involve further introducing a carbon-bearing material, such as acetylene, to the nitriding atmosphere, for example at the end of the nitriding process. The term "carbon-bearing material" as used herein may encompass any material that provides a suitable source of carbon for the carbonitriding process. The carbon-bearing material preferably comprises one or more of methane, propane, natural gas, methanol, charcoal and carbon monoxide, for example. Typically, however, only one type of gas is introduced into the atmosphere at a time. As used herein, the term "nitrided steel component," for example, may therefore encompass a "carbonitrided steel component" when used in connection with this embodiment. However, preferably, the method of the invention is applied to high-carbon steels, and therefore comprises only nitriding the steel component, i.e. not carbonitriding the steel component.

Step (ii) of nitriding the steel component may be carried out in a low-pressure furnace, for example. Suitable furnaces are known to the skilled person. The process environment may be provided by the introduction ammonia (for nitrogen) into a furnace, for example. Suitable methods of introducing these gases are known to the skilled person. By maintaining the proper ratios of the working gas (i.e. ammonia), the component is provided with a thin nitrided layer of nitrogen-rich steel. In other words, nitriding may comprise heating the steel component in an atmosphere comprising nitrogen atoms (from ammonia, for example).

The time limits of step (ii) may encompass the total time at which the required temperature and pressure conditions are applied, for example. In other words, the temperature and pressure may be applied in a plurality of separate, discrete steps, and the total time for which the required temperature and pressure is applied is from 30 minutes to 8 hours.

In some embodiments, the method preferably comprises a plurality of nitriding steps (ii) prior to the further treatment step (iii). However, preferably, the method involves a single nitriding step (ii) prior to the further treatment step (iii).

Step (ii) preferably does not comprise a carbon boosting step. In other words, step (ii) preferably does not comprise the addition of acetylene (or similar) at the end of the nitriding step.

Preferably, step (ii) consists of nitriding the steel component at a temperature of 800 to 920° C. and a pressure of 20 to 50 mbar for 30 minutes to 8 hours to form a nitrided steel component.

After step (ii) of nitriding the steel component, the method comprises (iii) subjecting the nitrided steel component to a further treatment. In other words, step (iii) comprises subjecting the nitrided steel component from step (ii) to a further treatment. The term "further treatment" as used herein may encompass applying a pre-determined pressure and temperature profile, cycle or sequence to the nitrided steel component, for example. Step (iii) may also comprise applying further and/or other physical and/or chemical processes to the nitrided steel component. In the present invention, step (iii) of subjecting the nitrided steel component to a further treatment comprises heating at a temperature of 800 to X° C. and a pressure of 1400 to 3000 mbar for at least 30 minutes, where X° C. is about 80° C. less than the melting temperature of the steel, preferably where X° C. is 80° C. less than the melting temperature of the steel. In other words, step (iii) of subjecting the nitrided steel component to a further treatment may comprises treating the nitrided steel component at a temperature of 800 to X° C. and a pressure of 1400 to 3000 mbar for at least 30 minutes, where X° C. is about 80° C. less than the melting temperature of the steel.

For the avoidance of doubt, step (iii) involves simultaneously applying a temperature of 800 to X° C. and a pressure of 1400 to 3000 mbar, for at least 30 minutes.

The melting temperature of the steel, i.e. the melting temperature of the steel of the steel component, will be well-known to the skilled person and can be determined from the literature or by conventional measurement techniques, for example. Simulation software for calculating the melting temperature as a function of chemical composition may also be used, such as ThermoCalc, for example.

Typically, the melting temperature of the steel may be from about 1420 to about 1550° C., for example. Accordingly, preferably, X is about 80° C. less than a value from about 1420 to about 1550° C. The melting temperature of a steel component may be from about 1450 to about 1540° C., for example. The melting temperature of the steel may not be a fixed value. In such cases, about 80° C. less than the melting temperature of the steel is to be understood as being about 80° C. less than the lower limit of the melting temperature of the steel, as measured by standard techniques, for example. This is because it is desirable to not even at least partially melt the steel during this step of the method of the invention.

The temperature and/or pressure during the further treatment step is not necessarily kept constant within the range of 800 to X° C. and from 1400 to 3000 mbar, respectively. That is, the temperature and/or pressure may be varied during step (iii).

If the temperature is too high, i.e. too close to the melting temperature of the steel, for example, then the steel may at least partially melt. This is not desirable because this process is not intended to substantially alter the bulk mechanical properties of the steel or change the shape of the steel component, for example, but to instead facilitate the diffusion of carbon and/or nitrogen atoms at the surface of the steel component, for example, as described herein.

In an (alternative) preferred embodiment, X is 1350° C., preferably 1340° C., more preferably 1300° C., even more preferably 1250° C.

Step (iii) of subjecting the nitrided steel component to a further treatment may be carried out in a low-pressure furnace, for example. Suitable furnaces are known to the skilled person.

The time limits of step (iii) may encompass the total time at which the required temperature and pressure conditions are applied, for example. In other words, the temperature and pressure may be applied in a plurality of separate, discrete steps, and the total time for which the required temperature and pressure is applied is at least 30 minutes. However, more preferably the temperature and pressure of step (iii) is applied continuously for at least 30 minutes.

In some embodiments, the method preferably comprises a plurality of further treatment steps (iii). However, more preferably, the method of the invention consists of a single further treatment step (iii).

Preferably, step (iii) comprises maintaining the pressure of 1400 to 3000 mbar by the introduction of nitrogen gas. In other words, step (iii) preferably comprises maintaining the pressure of 1400 to 3000 mbar by the introduction of nitrogen gas (N 2) into the system, such as the chamber, i.e. reaction chamber, or furnace. That is, nitrogen gas may be used to help maintain the controlled overpressure. Without wishing to be bound by theory, it is thought that maintaining a high-pressure atmosphere of mainly nitrogen may advantageously assist in ensuring that nitrogen primarily diffuses into, rather than back out of, the surface of the nitrided steel component. Accordingly, preferably, the atmosphere during the further treatment comprises at least 90 vol. % nitrogen gas (N 2) based on the total volume of the atmosphere or system, more preferably at least 95 vol. % nitrogen gas, even more preferably at least 97 vol. % nitrogen gas, even more preferably at least 98 vol. % nitrogen gas, even more preferably at least 99 vol. % nitrogen gas, even more preferably at least 99.5 vol. % nitrogen gas, still more preferably the atmosphere during the further treatment consists essentially of or consists of nitrogen gas, together with any unavoidable impurities. Unavoidable impurities may be present, for example, in an amount of less than 0.1 vol. % based on the total volume of gas in the system, such as in the chamber or furnace. Such a method may therefore assist in achieving the advantageous surface carbon and nitrogen profiles discussed herein.

Optionally, step (iii) further comprises introducing ammonia into the atmosphere of the further treatment while the temperature is within the range of 800° C. to 920° C. The ammonia may be introduced in the preferred concentrations described herein. Introduction of ammonia during this step may assist in further increasing the nitrogen enrichment of the steel.

Preferably, step (ii) and/or step (iii) is terminated by gas quenching or hot bath controlled cooling, i.e. gas quenching or hot bath cooling the steel component. In other words, in step (ii) and/or step (iii), the steel component is cooled after being heated for the required time by either gas quenching or hot bath controlled cooling methods. Such methods are known to the skilled person. The gases of the gas quenching preferably comprise nitrogen gas and/or helium gas. Such methods of cooling may enable the advantageous surface carbon and nitrogen profiles discussed herein to be maintained, while also achieving and/or maintaining the desired mechanical properties of the steel component.

Preferably, step (ii) comprises two or more discrete ammonia pulses, the atmosphere of the nitriding treatment comprising ammonia during each ammonia pulse and comprising substantially no ammonia between the ammonia pulses. The term "substantially no ammonia" as used herein may encompass that the atmosphere of the nitriding step comprises less than 1 vol. % ammonia based on the total volume of the atmosphere or system, preferably less than 0.5 vol. % ammonia, more preferably less than 0.2 vol. % ammonia, even more preferably less than 0.1 vol. % ammonia. During each discrete ammonia pulse, the atmosphere of the nitriding treatment comprises ammonia in the preferred amounts described elsewhere herein. The term "pulse" as used herein may encompass, for example, a discrete burst or period of time at which the desired concentration of ammonia gas is maintained in the atmosphere of the nitriding treatment. The required temperature and pressure treatment of step (ii) is maintained during each ammonia pulse. Between each ammonia pulse, the temperature of step (ii) is maintained. However, in order to remove the ammonia from the system, a depressurizing step may be performed. The depressurizing step may comprise reducing the pressure to 50 mbar or less, preferably 30 mbar or less, more preferably 10 mbar or less, still more preferably 5 mbar or less, even more preferably 1 mbar or less. Such a method may assist in achieving the advantageous surface carbon and nitrogen profiles discussed herein. Preferably, each discrete ammonia pulse is independently applied for 30 minutes to 8 hours, preferably from 30 minutes to 3 hours, more preferably for 45 minutes to 2 hours, even more preferably for 1 hour to 90 minutes. Preferably, step (ii) consists of two or three, preferably two, discrete ammonia pulses. Such a method may assist in achieving the advantageous surface carbon and nitrogen profiles discussed herein.

Preferably, step (ii) comprises nitriding the steel component at a temperature of 800 to 920° C. and a pressure of 20 to 40 mbar for 30 minutes to 8 hours to form a nitrided steel component. Preferably, step (ii) comprises nitriding the steel component: at a temperature of 800 to 850° C.; and/or at a pressure of 25 to 35 mbar; and/or for 1 to 3 hours. Preferably, step (ii) comprises nitriding the steel component at a temperature of about 800° C. Preferably, step (ii) comprises nitriding the steel component at a pressure of 27 to 33 mbar, more preferably from 29 to 31 mbar, most preferably about 30 mbar. Preferably, step (ii) comprises nitriding the steel component for 1.5 hours to 2.5 hours, more preferably about 2 hours. Preferably, the temperature is maintained at a constant temperature for the entire time range, excluding initial heating-up and final cooling-down steps. Preferably, the pressure is maintained at a constant pressure for the entire time range, excluding initial depressurizing and final pressurizing steps. Step (ii) may also preferably comprise further steps of reducing the pressure to 5 mbar or less, preferably 1 mbar or less, prior to applying the pressure of 20 to 50 mbar. Such pressure reductions may be applied for a period of 1 to 30 minutes, for example. Such a method may assist in achieving the advantageous surface carbon and nitrogen profiles discussed herein.

Preferably, the further treatment of step (iii) comprises heating at a temperature of 800 to X° C. and a pressure of 1400 to 1600 mbar for 30 minutes to 8 hours. Such a method may assist in achieving the advantageous surface carbon and nitrogen profiles discussed herein.

Preferably, in step (iii), X is 100° C. less than the melting temperature of the steel, more preferably 150° C. less than the melting temperature of the steel, even more preferably 200° C. less than the melting temperature of the steel. In an (alternative) preferred embodiment, step (iii) comprises subjecting the nitrided steel component to a further treatment comprising heating at a temperature of 800 to 1350° C. and a pressure of 1400 to 3000 mbar for 30 minutes to 14 hours (preferably from 30 minutes to 8 hours), preferably subjecting the nitrided steel component to a further treatment comprising heating at a temperature of 800 to 1350° C. and a pressure of 1400 to 1600 mbar for 30 minutes to 14 hours (preferably from 30 minutes to 8 hours). The time required for the further treatment step may depend on the temperature, for example.

Preferably, the further treatment of step (iii) comprises treating the nitrided steel component at a pressure of 1400 to 2000 mbar, preferably from 1400 to 1800 mbar.

Preferably, the further treatment of step (iii) comprises treating the nitrided steel component: at a temperature of 1000 to 1100° C.; and/or at a pressure of 1450 to 1550 mbar; and/or for 1 to 3 hours. Preferably, the further treatment of step (iii) comprises treating the nitrided steel component at a temperature of 900 to 1200° C., more preferably from 1000 to 1100° C., even more preferably from 1020 to 1080° C., still more preferably about 1050° C. Preferably, the further treatment of step (iii) comprises treating the nitrided steel component at a pressure of 1470 to 1530 mbar, more preferably about 1500 mbar. Preferably, the further treatment of step (iii) comprises treating the nitrided steel component for 1.5 hours to 2.5 hours, more preferably about 2 hours. Preferably, the temperature is maintained at a constant temperature for the entire time range, excluding initial heating-up and final cooling-down steps. Preferably, the pressure is maintained at a constant pressure for the entire time range, excluding initial and final pressurizing or depressurizing steps. Step (iii) may also preferably comprise further steps of reducing the pressure to 5 mbar or less, preferably 1 mbar or less, prior to applying the pressure of 1400 to 3000 mbar. Such pressure reductions may be applied for a period of 1 to 30 minutes, for example. Preferably, the temperature is ramped to the desired temperature range of 800 to X° C. over a period of up to 2 hours. The pressure reduction steps are preferably applied during this temperature ramping step. Alternatively, the pressure reduction steps are preferably applied between after step (ii) and before step (iii). For example, in a first preferred embodiment, the pressure reduction steps are applied during the temperature ramping step. In a second alternative preferred embodiment, the pressure reduction steps are performed after step (ii) and before the temperature ramping step, before quenching to room temperature (such as about 20° C.) and then applying the temperature ramping step. In a third alternative preferred embodiment, there are no pressure reduction steps between step (ii) and step (iii), and between step (ii) and step (iii) the temperature is reduced to from 550 to 690° C. for 1 to 2 hours to pearlitise the steel and/or to cause grain refinement of the steel, for example. Grain refinement of the steel may help in improving the wear resistance of the resulting heat-treated steel component. The first and third alternative preferred embodiments may be the most economical. Such methods may assist in achieving the advantageous surface carbon and nitrogen profiles discussed herein.

Preferably, the steel component is formed of a high carbon steel and/or a bearing steel. Although the present disclosure, in general, is not particularly limited to a certain type or grade of steel, the method of the present disclosure maybe particularly effective for high carbon steels. The term "high carbon steel" is a term of art that is well-known to the skilled person. The term "bearing steel" is also a term of art that is well-known to the skilled person. A high carbon steel may preferably comprise from 0.60 to 1.20 wt. % carbon, based on the total weight of the steel component, for example. Other steels that may be used in the present invention may comprise from 0.50 to 1.20 wt. % carbon. For example, preferably the steel component comprises or is made of a bearing steel. Suitable bearing steels are known to the skilled person. Preferably, the steel component comprises or is made of a low-alloy steel. Suitable low-alloy steels are known to the skilled person. In some embodiments, the method may also be applied to lower-carbon steels, such as steels comprising from 0.10 to 1.20 wt. % carbon. Suitable steels for a steel component on which the method may be applied include, for example, grade 3/SAE 52100/100Cr6 steel; grade 5/100CrMo7-3 steel; and grade 6/100CrMo7-4 steel, for example. Such steels are known to the skilled person.

In some preferred embodiments, the steel component comprises or constitutes a rolling element or roller, or a steel component for an application in which the steel component is subjected to alternating Hertzian stresses, such as rolling contact or combined rolling and sliding, such as a slewing bearing or a raceway for a bearing. The component may include or constitute gear teeth, a cam, shaft, bearing, fastener, pin, automotive clutch plate, tool, or a die. The steel component may for example constitute at least part of a roller bearing, a needle bearing, a tapered roller bearing, a spherical roller bearing, a toroidal roller bearing or a thrust bearing. The component may be used in food & beverage, automotive wind, marine, metal producing or other machine applications which require high wear resistance and/or high corrosion resistance and/or increased fatigue and/or tensile strength. The steel component may be used in any application in which it is likely to be subjected to high temperature (e.g. about 200 to about 350° C.), stress, strain, impact and/or wear under a normal operational cycle, such as in under contaminated and/or poor lubricant conditions.

In a further aspect, the disclosure provides a heat-treated steel component obtained or obtainable by the method described herein, preferably wherein the heat-treated steel component comprises or constitutes a rolling element or roller, or an inner or outer ring of a bearing. In other words, the present disclosure also provides a heat-treated steel component treated by the method of heat treating a steel component described herein. The technical effects and advantages, as well as any preferred features, of the first aspect apply equally to this aspect.

In a further aspect, the present disclosure also encompasses a steel component that has been treated by low pressure nitriding and that has a substantially uniform carbon and/or nitrogen content between 0 and 250 μm from the surface of the steel component in a direction perpendicular to the surface of the steel component. The term "substantially uniform" as used herein may encompass that that the content (in wt. % relative to the total weight of the steel component) of carbon and/or the content of nitrogen varies within the stated distance from the surface of the steel component by less than 10%, preferably less than 5%, more preferably less than 3%, even more preferably less than 1%, still more preferably less than 0.5%, respectively. The technical effects and advantages, as well as any preferred features, of the first aspect apply equally to this aspect. As discussed above, such technical features may be made possible by the additional pressure-and-heat treatment step (iii) of the method of the present disclosure. It may be possible to distinguish such a heat-treated steel component from conventional heat-treated steel components for the reasons described herein, such as the carbon and nitrogen surface profiles and the level of oxidisation at the grain boundaries.

BRIEF DESCRIPTION OF THE DRAWINGS

Embodiments of the invention will now be described in relation to the following non-limiting drawings, in which.

DETAILED DESCRIPTION

It should be noted that the drawings have not been drawn to scale and that the dimensions of certain features have been exaggerated for the sake of clarity.

Figure 1:
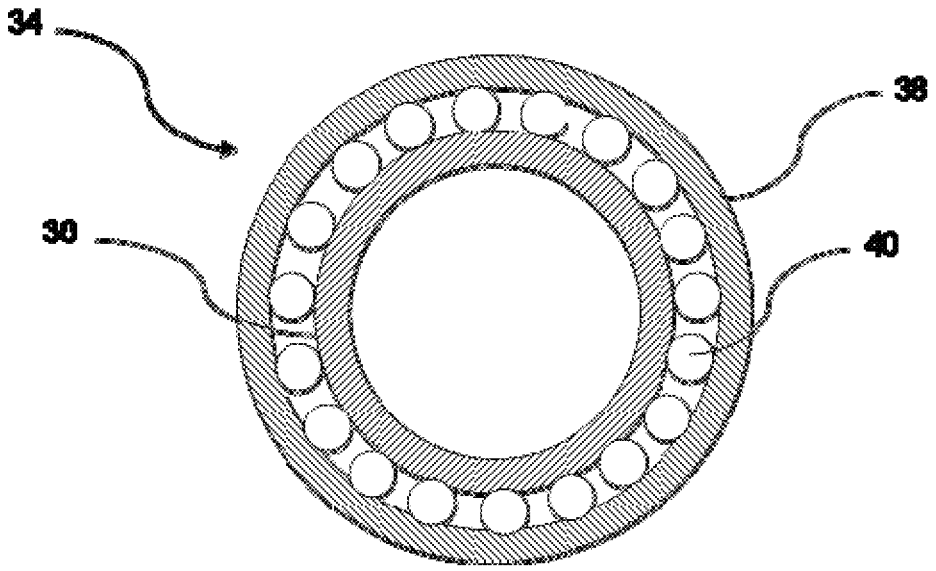
FIG. 1 is a schematic side elevational view of a bearing having an inner ring, and outer ring and a plurality of rolling elements according to an embodiment of the disclosure.

FIG. 1 shows an example of a steel component according to an embodiment of the invention, namely a rolling element bearing 34 that may range in size from 10 mm diameter to a few meters in diameter and have a load-carrying capacity from a few tens of grams to many thousands of tonnes. The bearing 34 according to the present invention may namely be of any size and have any load-carrying capacity. The bearing 34 has an inner ring 36 and an outer ring 38 and a set of rolling elements 40. The inner ring 36, the outer ring 38 and/or the rolling elements 40 of the rolling element bearing 34, and preferably at least part of the surface of all of the rolling contact parts of the rolling element bearing 40 may be subjected to a method according to the present disclosure.

Figure 2:
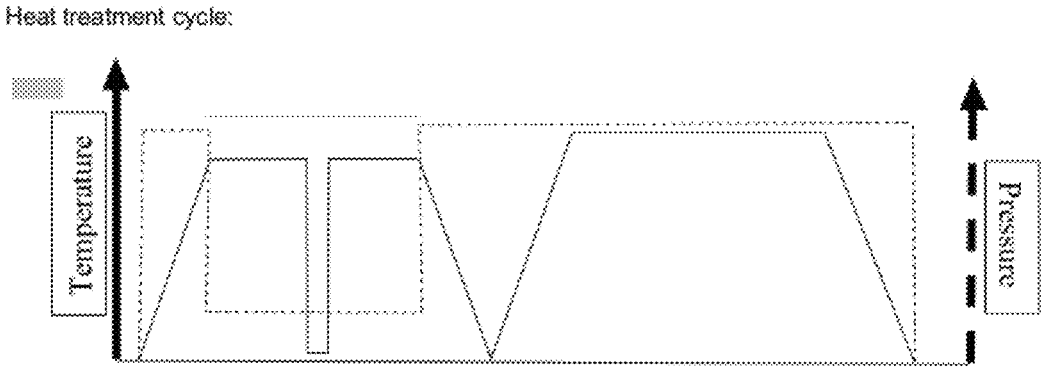
FIG. 2 is a schematic representation of a heat treatment cycle according to an embodiment of the method of the present disclosure.

FIG. 2 shows a schematic of a heat treatment cycle according to an embodiment of the method of the present disclosure. In FIG. 2, the solid line represents the temperature, the dashed line represents the pressure, and the x-axis represents time, from left to right. In particular, in the method of FIG. 2, it can be seen that step (ii) involves two discrete ammonia pulses. The dip in the solid line actually represents a reduction in the concentration of ammonia in the nitriding atmosphere, and not the temperature.

Examples of the method of the disclosure will now be described.

Three steel components (not illustrated), each made of a different grade of steel, were subjected to a heat treatment according to the method of the present disclosure. In particular, in step (ii) the temperature was 800° C., the pressure was 30 mbar, and the time was 2 hours total. Step (ii) included two discrete ammonia pulses of equal length. In step (iii), the temperature was 1050° C., the pressure was 1500 mbar, and the time was 2 hours total.

Chemical analysis at the surface of each heat-treated steel component was conducted using Glow Discharge Optical Emission Spectrometry (GDOES) between step (ii) and step (iii), and after step (iii). The results are shown in FIGS. 3, 4 and 5.

Figure 3A:
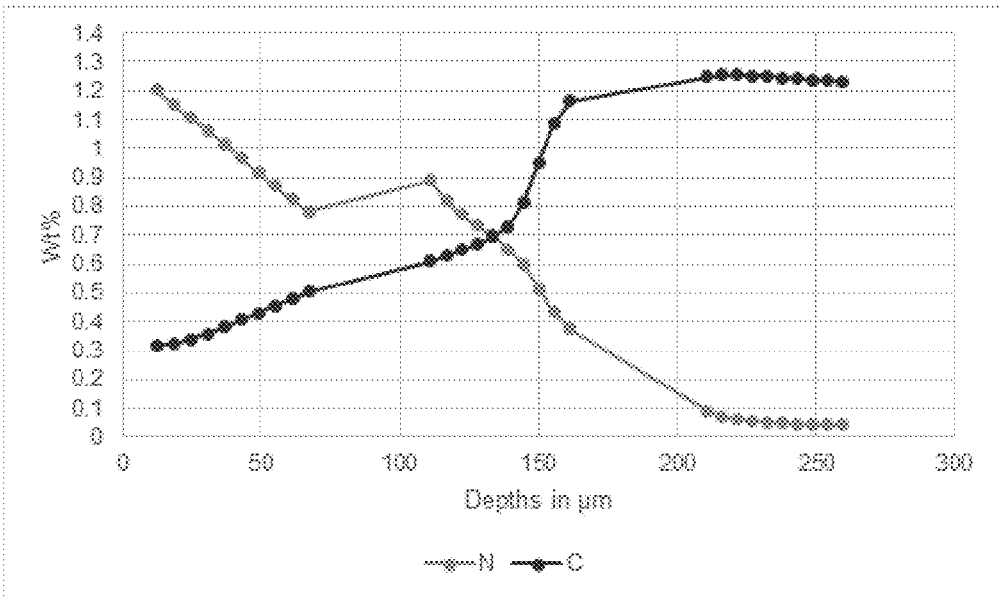
FIG. 3A is a graph the surface carbon content and nitrogen content, respectively, of a first steel component treated by step (ii) of the disclosed method and not by step (iii) of the disclosed method.
Figure 3B:
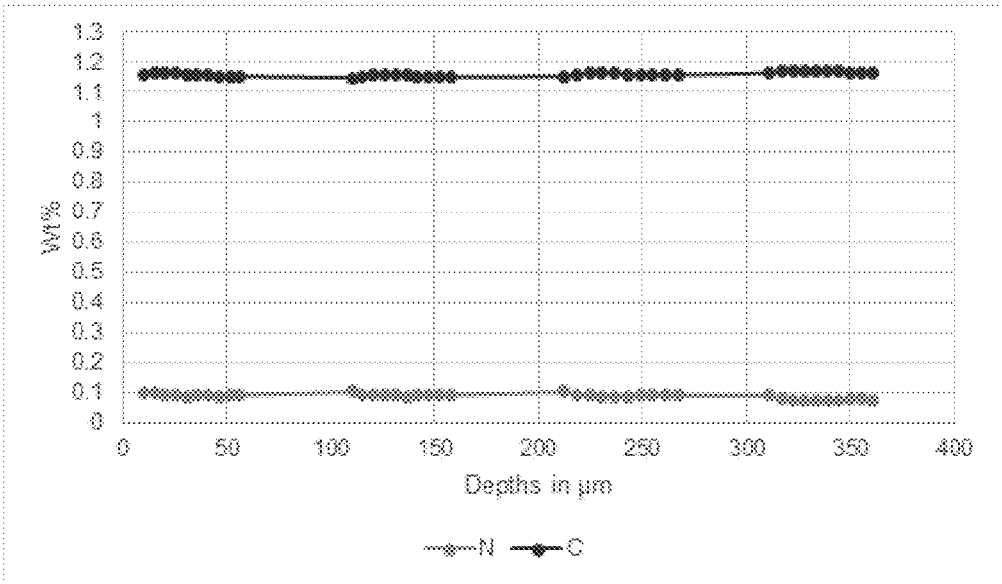
FIG. 3B is a graph of the surface carbon content and nitrogen content, respectively, of the same first steel component as in FIG. 3A, when further treated by step (iii) of the disclosed method.
Figure 4A:
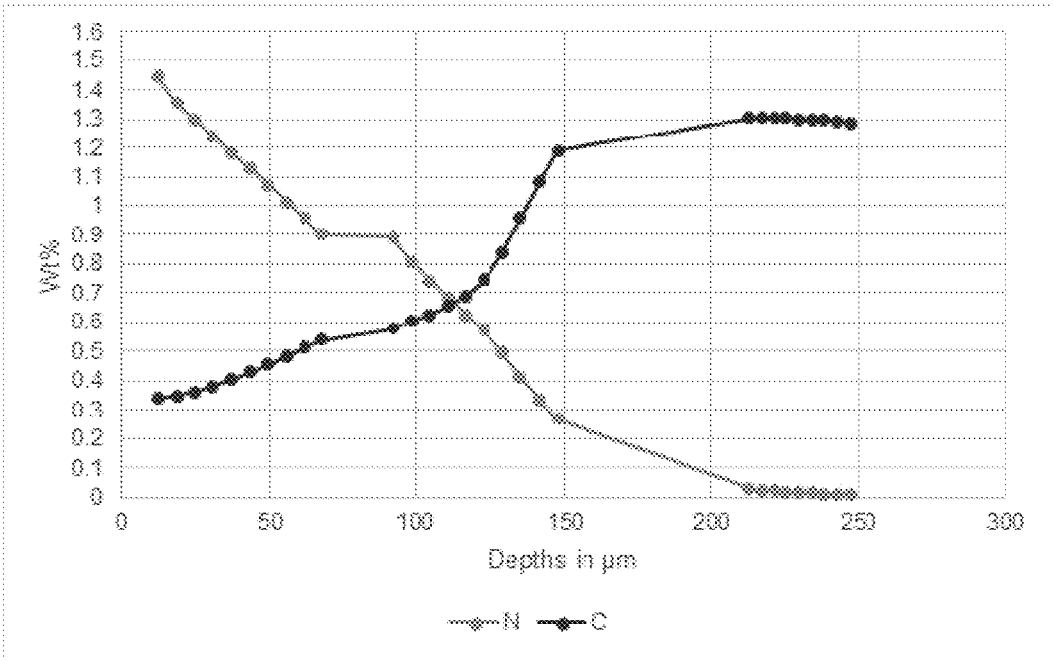
FIG. 4A is a graph of the surface carbon content and nitrogen content, respectively, of a second steel component treated by step (ii) of the disclosed method and not by step (iii) of the disclosed method.
Figure 4B:
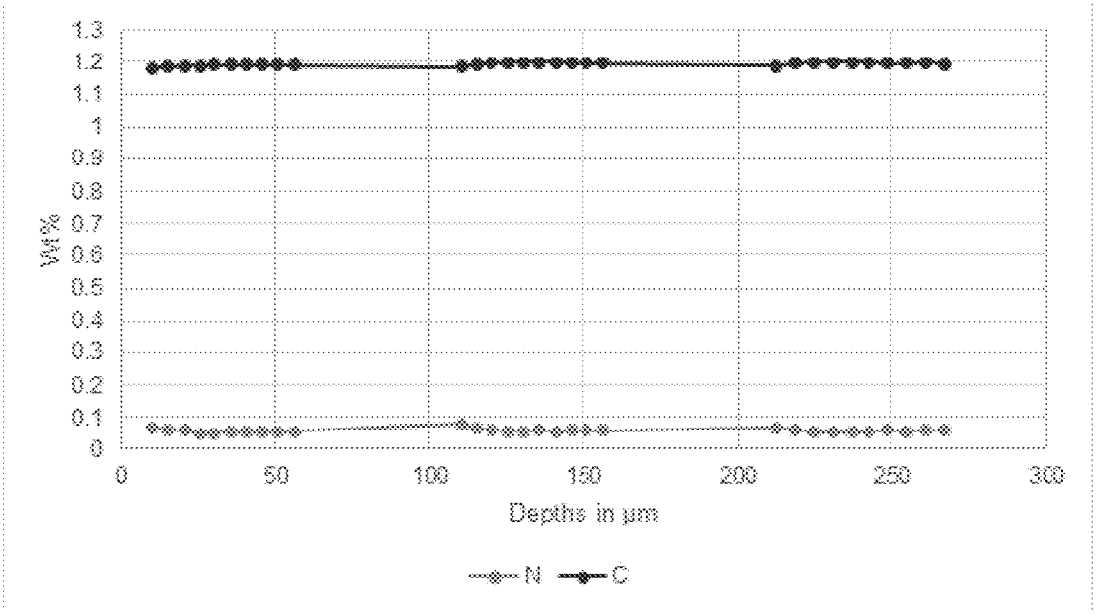
FIG. 4B is a graph of the surface carbon and nitrogen content, respectively, of the same second steel component as in FIG. 4A, when further treated by step (iii) of the disclosed method.
Figure 5A:
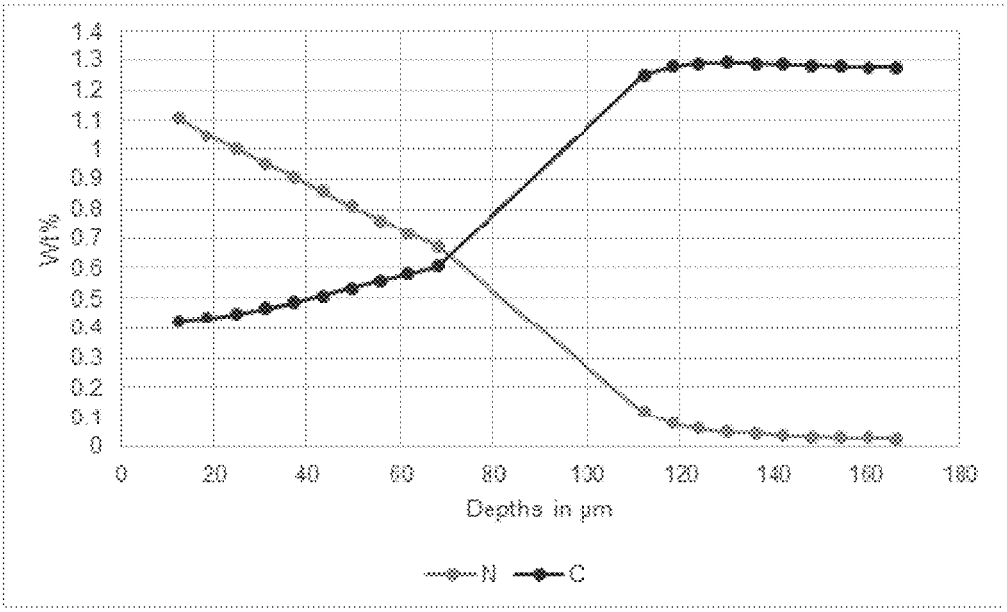
FIG. 5A is a graph of the surface carbon content and nitrogen content, respectively, of a third steel component treated by step (ii) of the disclosed method and not by step (iii) of the disclosed method.
Figure 5B:
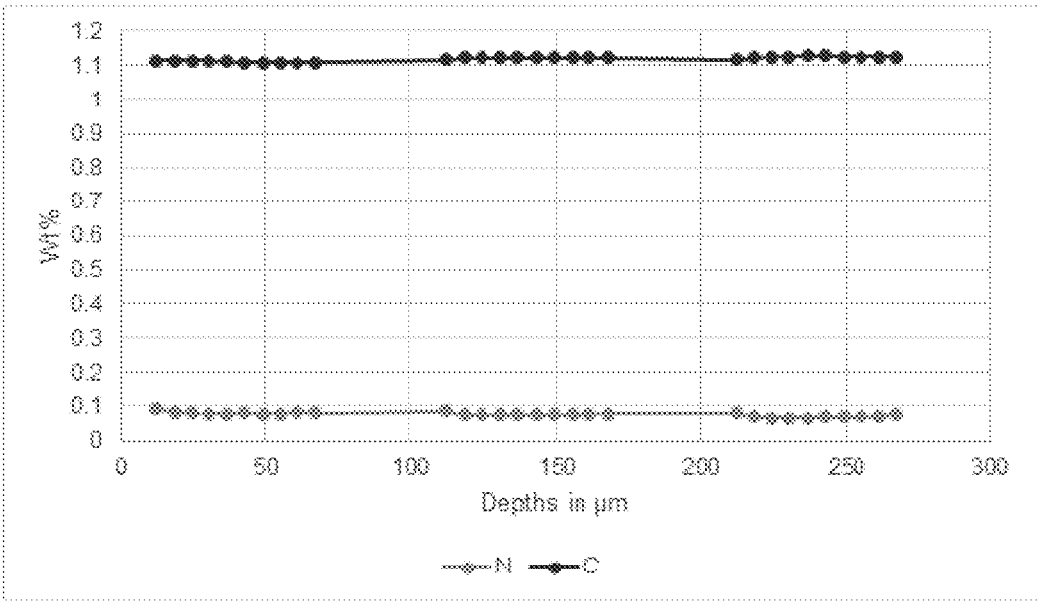
FIG. 5B is a graph of the surface carbon content and nitrogen content, respectively, of the same third steel component as in FIG. 5A, when further treated by step (iii) of the disclosed method.

In particular, FIGS. 3A, 4A and 5A each show the carbon and nitrogen content at the surface of the steel component between step (ii) and step (iii), whereas FIGS. 3B, 4B and 5B each show the carbon and nitrogen content at the surface of the steel component after step (iii) has been performed. In FIG. 3, a grade 3 (52100) steel was used. In FIG. 4, a grade 5 (100CrMo7-3) steel was used. In FIG. 5, a grade 6 (100CrMo7-4) steel was used. The upper line at the deepest case depth on each figure represents the carbon content of the steel.

As described herein, the results clearly demonstrate that after the LPN step (ii) only (i.e. in FIGS. 3A, 4A and 5A), the carbon content near the surface is very low and increases to a higher content than in the raw material away from the surface, and the nitrogen content near the surface is high, but rapidly decreases away from the surface. After step (iii) (i.e. in FIGS. 3B, 4B and 5B), it can then be seen that the uphill diffusion of carbon is effectively reversed, and the nitrogen diffuses further into the steel component, away from the surface, thereby providing a much more uniform distribution of both carbon and nitrogen in the first 250 μm of the surface of the steel component, for example.

The foregoing detailed description has been provided by way of explanation and illustration, and is not intended to limit the scope of the appended claims. Many variations in the presently preferred embodiments illustrated herein will be apparent to one of ordinary skill in the art and remain within the scope of the appended claims and their equivalents.

What is claimed is:

1. A method of heat treating a steel component, comprising:

(i) providing the steel component;

(ii) nitriding the steel component at a temperature of 800 to 920° C. and a pressure of 20 to 50 mbar for 30 minutes to 8 hours to form a nitrided steel component; and (iii) after step (ii) heating the nitrided steel component at a temperature of 800 to X° C. and a pressure of 1400 to 3000 mbar for at least 30 minutes, where X° C. is about 80° C. less than a melting temperature of the steel.

2. The method according to claim 1, wherein step (iii) comprises maintaining the pressure of 1400 to 3000 mbar by introducing nitrogen gas into a chamber containing the steel component.

3. The method according to claim 1, including terminating step (ii) by gas quenching or hot bath controlled cooling.

4. The method according to claim 3, including terminating step (iii) by gas quenching or hot bath controlled cooling.

5. The method according to claim 1, wherein step (ii) comprises providing two or more discrete ammonia pulses such that the atmosphere surrounding the component comprises about 100 vol % ammonia during each ammonia pulse and comprises substantially no ammonia between the ammonia pulses.

6. The method according to claim 5, wherein each of the discrete ammonia pulses is independently applied for 30 minutes to 8 hours.

7. The method according to claim 1, wherein step (iii) is performed for 30 minutes to 8 hours.

8. The method according to claim 1, wherein step (ii) comprises nitriding the steel component at a temperature of 800 to 850° C. or at a pressure of 25 to 35 mbar or for 1 to 3 hours.

9. The method according to claim 1, wherein step (ii) comprises nitriding the steel component at a temperature of 800 to 850° C. and at a pressure of 25 to 35 mbar for 1 to 3 hours.

10. The method according to claim 1, wherein step (iii) comprises treating the nitrided steel component at a temperature of 1000 to 1100° C. or at a pressure of 1450 to 1550 mbar or for 1 to 3 hours.

11. The method according to claim 1, wherein step (iii) comprises treating the nitrided steel component at a temperature of 1000 to 1100° C. and at a pressure of 1450 to 1550 mbar for 1 to 3 hours.

12. The method according to claim 1, wherein the steel component comprises a carbon steel or a bearing steel.

13. The method according to claim 1, including terminating step (ii) and step (iii) by gas quenching or hot bath controlled cooling, wherein step (ii) comprises providing two or more discrete ammonia pulses, each for 30 minutes to 8 hours, such that the atmosphere surrounding the component comprises about 100 vol % ammonia during each ammonia pulse and comprises substantially no ammonia between the ammonia pulses, wherein step (ii) comprises nitriding the steel component at a temperature of 800 to 850° C. and at a pressure of 25 to 35 mbar for 1 to 3 hours, wherein step (iii) comprises treating the nitrided steel component at a temperature of 1000 to 1100° C. and at a pressure of 1450 to 1550 mbar for 1 to 3 hours, wherein step (iii) comprises maintaining the pressure of 1400 to 3000 mbar by introducing nitrogen gas into a chamber containing the steel component, wherein the steel component comprises a carbon steel or a bearing steel, and wherein X is from 1350° C. to 1250° C.

14. The method according to claim 1, wherein X is from 1350° C. to 1250° C.

15. The method according to claim 1, wherein X is about 1250° C.

16. A heat-treated steel component obtained by the method of claim 1.

17. The heat-threated steel component of claim 16, wherein the component comprises a bearing rolling element or a bearing roller, or a bearing inner ring or a bearing outer ring.

* * * * *